United States Patent [19]

Franke et al.

[11] Patent Number: 5,009,671

[45] Date of Patent: Apr. 23, 1991

[54] PROCESS FOR PRODUCING A SOLID, FINELY DIVIDED FUEL BASED ON COAL

[76] Inventors: Friedrich H. Franke, Rieperting 3, 8201 Schonstett; Michael J. Paersch, Rönkrei 6, 2000 Hamburg 65, both of Fed. Rep. of Germany

[21] Appl. No.: 364,358

[22] Filed: Jun. 9, 1989

[30] Foreign Application Priority Data

Jun. 29, 1988 [DE] Fed. Rep. of Germany ..... 3821950

[51] Int. Cl.[5] ..... C10L 5/14; C10L 5/28

[52] U.S. Cl. ..... 44/598; 44/560

[58] Field of Search ..... 44/15 B, 15 C, 21, 25, 44/16 R, 598

[56] References Cited

U.S. PATENT DOCUMENTS

| | | | |
|---|---|---|---|
| 3,026,189 | 3/1962 | Hall | 44/15 C |
| 4,738,685 | 4/1988 | Goleczka et al. | 44/15 B |

FOREIGN PATENT DOCUMENTS

| | | | |
|---|---|---|---|
| 11989 | of 1928 | Australia | 44/15 B |
| 21755 | of 1905 | United Kingdom | 44/15 C |
| 417126 | 9/1934 | United Kingdom | 44/15 C |
| 421018 | 12/1934 | United Kingdom | 44/15 C |
| 673659 | 6/1952 | United Kingdom | 44/15 B |

*Primary Examiner*—Carl F. Dees

[57] ABSTRACT

Water resistant coal briquettes are obtained by mixing finely divided coal with a first starchy binder in an amount of 0.5 to 3 wt % and with a second binder that contains molasses or fermented molasses (vinasse) and water in an amount of 1 to 4 wt %, and the green briquettes produced from this mixture are subjected to a heat treatment in at least two steps, whereby the green molded articles are first pretreated at 80° to 150° C. and optionally dried and then hardened at 200° to 300° C.

6 Claims, No Drawings

PROCESS FOR PRODUCING A SOLID, FINELY DIVIDED FUEL BASED ON COAL

BACKGROUND OF THE INVENTION

Fine coal can be molded with the help of a external pressure in briquetting or extrusion installations or by agglomeration, e.g., pelletization. As a rule, one or more binders is added to the fine coal before the molding operation in order to impart adequate strength to these briquettes. Often molding must be followed by a thermal treatment and hardening with subsequent cooling of the briquettes, depending on the binder used.

The binders generally used, e.g., for anthracite briquettes, are substances that contain sulfur such as bitumen or sulfite waste liquor, but their sulfur content is unwanted for reasons of environmental protection. French Patent 861,930 describes sulfur-free binders of the type mentioned initially, e.g., a combination of powdered manioc (cassava) and molasses, but the resultant coal briquettes do not have adequate water resistance.

This invention is therefore based on a process to produce coal briquettes with a high water resistance despite the fact that they contain sulfur-free binders of the type mentioned above.

SUMMARY OF THE INVENTION

This problem is solved according to this invention by the fact that the green molded products are subjected to a least a two-step heat treatment whereby they are first treated at 80° C. to 150° C. and optionally dried and then hardened at 200° C. to 300° C.

According to an advantageous version of this invention, a first binder is used that contains starch that has been converted to a paste and the pretreatment and drying are performed at 100° C. to 150° C. As an alternative, a first binder that contains a starch that has not been converted to a paste may be used and then the resultant green molded product containing at least 5 wt% water based on the mixture of binder and finely divided coal is pretreated first at 80° C. to 100° C., especially 80° C. to 95° C., to convert the starch to a paste and then optionally is dried at 100° C. to 150° C.

Preferably, the pretreatment, drying and hardening take place in the presence of a gaseous medium.

According to another advantageous version of this invention, flour from the group consisting of grains, potatoes, corn, rice, tapioca and manioc (cassava) is used as the starchy binder. Industrial wastes containing these substances may also be used.

According to another advantageous version of this invention, up to 2 wt% based on coal (moisture-free) of a water repellent synthetic resin, especially a silicon resin, is added to the mixture of finely divided coal and binders.

Finally, it may be advantageous to add halogen- and sulfate-free calcium compounds together with halogen- and sulfate-free iron compounds or iron or industrial iron wastes to the mixture of finely divided coal and binders in order to reduce the nitrogen oxide and sulfur oxide content in the flue gases formed by combustion of the coal briquettes. Such additives are described in German Patent OLS 3,432,365.

The duration of the heat treatment steps in the process according to this invention depends on the type of starchy binder and molasses or vinasse (fermented molasses), the shape and size of the coal briquettes, the velocity of flow of the gases use din the heat treatment, etc. However, it can be determined easily by testing the compressive strength and water resistance of the coal briquettes.

When using starch that has not been first converted to a paste, the duration of the pretreatment is of crucial importance in determining the hardness of the finished coal briquettes. If the pretreatment is too short and the conversion of the starch to paste is inadequate, the resultant briquettes will have an adequate strength despite the subsequent treatment in the actual hardening step (200–300° C.). On the other hand, it has been found that it is practically impossible to further increase the final strength of the coal briquettes, even by lengthening the pretreatment period, if complete conversion of the starch to paste does not take place until the pretreatment stage.

The hardening step (heat treatment at 100° C. to 300° C.) is extremely important for the water resistance of finished coal briquettes. This treatment time is regarded as adequate if there is no clouding of the water due to fine components of the coal briquettes in water storage of the hardened coal briquettes after 24 hours. If clouding of the water occurs, especially due to the second sugary binder being dissolved out of the briquettes, then the treatment time in the hardening step (200° C. to 300° C.) has been too short.

When using binders containing starch that has not first been converted to a paste, the conversion of starch to paste can be promoted by the known additives, e.g., sodium hydroxide solution.

DETAILED DESCRIPTION OF THE INVENTION

The process according to this invention will be explained in greater detail below on the basis of a preferred practical example.

The coal material was a fine-grained anthracite (mesh size 95 wt% <1 mm) with a water content of 10 wt% (based on coal). Finely ground but otherwise untreated powdered starch (starch content 70 wt%, screen mesh size A90 wt% <0.09 mm) in a weight amount of 2.5% (based on coal) was incorporated into the fine-grained coal together with 5 wt% cane molasses (45 wt% water content) and 0.2 wt% silicone resin The experimental batch was mixed thoroughly.

Then the resultant mixture was pelletized in a known way in a conventional pelletizing installation with the addition of water.

The pretreatment and hardening of the pellets were performed in a laboratory dryer in which the pellets were exposed to the oncoming flow of hot gas (air) while arranged in a stationary bed on a screen with a bed height of 10 cm. The pellets were first treated for 20 minutes at a hot gas temperature of 90ρc, whereupon a certain drying occurred in addition to conversion of the starch to paste. Then the pellets were hardened for 60 minutes at 270° C. The coal pellets produced in this way had a compressive strength of 60 kg per pellet when cooled and had a compressive strength of 47 kg per pellet after a storage period of 24 hours in water with a water uptake of 7 wt%.

We claim:

1. A process for producing a substantially water resistant coal briquettes comprising:

(a) heating a green molded coal briquette comprising a mixture of finely divided coal, a first binder containing starch in an amount of 0.5 to 3 wt% and a second binder comprising molasses and water in an amount of 1 to 4 wt% to a first temperature between 80° C. to 150° C. for a time sufficient to convert said starchy binder to a paste, and (b) heating said green molded coal briquette to a second temperature between 200° C. to 300° C. for a time sufficient to convert said green molded coal briquette into a substantially water resistant coal briquette.

2. A process for producing a substantially water resistant coal briquette comprising:

(a) heating a green molded coal briquette comprising a mixture of finely divided coal, a first binder containing a starch that has been converted into a paste, and a second binder containing molasses and water to a temperature between about 200° C. to 300 ° C. for a time sufficient to produce substantial water resistant coal briquette.

3. The process of claim 1 wherein said molasses comprising said second binder is fermented.

4. The process of claim 2 wherein said molasses comprising said second binder is fermented.

5. The process of claim 1 wherein said starch is selected from the group consisting of grains, potatoes, corn, rice, tapioca and manioc.

6. The process of claim 2 wherein said starch is selected from the group consisting of grains, potatoes, corn, rice, tapioca and manioc.

* * * * *